US011311057B2

(12) United States Patent
Nogawa et al.

(10) Patent No.: US 11,311,057 B2
(45) Date of Patent: Apr. 26, 2022

(54) BRASSIERE

(71) Applicant: Avoir International Co. Ltd., Kyoto (JP)

(72) Inventors: Kazuko Nogawa, Kyoto (JP); Mayumi Nakamura, Kyoto (JP); Meisei Takeishi, Shizuoka (JP)

(73) Assignee: AVOIR INTERNATIONAL CO. LTD., Kyoto (JP)

( * ) Notice: Subject to any disclaimer, the term of this patent is extended or adjusted under 35 U.S.C. 154(b) by 0 days.

(21) Appl. No.: 16/492,184

(22) PCT Filed: May 21, 2019

(86) PCT No.: PCT/JP2019/020023
§ 371 (c)(1),
(2) Date: Sep. 9, 2019

(87) PCT Pub. No.: WO2020/066119
PCT Pub. Date: Apr. 2, 2020

(65) Prior Publication Data

US 2021/0204618 A1 Jul. 8, 2021

(30) Foreign Application Priority Data

Sep. 26, 2018 (JP) ..... JP2018-180409

(51) Int. Cl.
*A41C 3/14* (2006.01)

(52) U.S. Cl.
CPC ..... *A41C 3/144* (2013.01); *A41C 3/142* (2013.01)

(58) Field of Classification Search
CPC ..... A41C 3/142; A41C 3/144; A41C 3/10; A41C 3/14; A41C 1/12; A41C 1/14; A41C 1/16; A41C 3/0035
(Continued)

(56) References Cited

U.S. PATENT DOCUMENTS

2011/0287691 A1* 11/2011 Hu ..... A41C 3/144 450/56
2012/0184180 A1* 7/2012 Hu ..... A41C 3/144 450/55
(Continued)

FOREIGN PATENT DOCUMENTS

JP S56-012241 3/1981
JP H11-012808 1/1999
(Continued)

*Primary Examiner* — Gloria M Hale
(74) *Attorney, Agent, or Firm* — Kirschstein, Israel, Schiffmiller & Pieroni, P.C.

(57) ABSTRACT

An adjustable brassiere includes a pair of cup parts, a base part supporting the cup parts, a back part, and straps. Each cup part has, on its back surface, an underbust adjustment pocket and a volume adjustment pocket. The base part is continuous with the cup parts and has a stretchable skin-side base part and a front-side base part that are layered. The front-side base part includes a wire insertion part that has substantially the same curve as a curve of a lower edge of the cup part on a front surface. The skin-side base part and the front-side base part are fixed to each other at the front center tops, side edges, and a lower end, and the cup lower edge of the skin-side base part and the wire insertion part of the front-side base part are not fixed to each other, except for both ends thereof.

8 Claims, 7 Drawing Sheets

(58) Field of Classification Search
USPC ..... 450/51, 52, 47, 49, 55
See application file for complete search history.

(56) References Cited

U.S. PATENT DOCUMENTS

| | | | | |
|---|---|---|---|---|
| 2016/0029706 | A1* | 2/2016 | Braverman | A41C 5/00 450/55 |
| 2016/0360800 | A1* | 12/2016 | Yuasa | A41F 1/006 |
| 2017/0150759 | A1* | 6/2017 | Hirakubo | A41C 3/10 |

FOREIGN PATENT DOCUMENTS

| | | |
|---|---|---|
| JP | 3178563 | 9/2012 |
| JP | 3213340 | 11/2017 |

* cited by examiner

BRASSIERE

TECHNICAL FIELD

The present invention relates to a brassiere that is adjustable according to different positions and sizes of the right and left breasts and is adaptable to changes in these positions and sizes.

BACKGROUND ART

For various reasons, there may be differences in the positions and sizes of the right and left breasts. In response to this, brassieres have been proposed for the purpose of eliminating physical difficulty resulting from differences in right and left breasts and eliminating the difference in appearance between the right and left breasts.

For example, Patent Document 1 discloses a brassiere having a pad fixed to one of the right and left cups to compensate for the difference in breast size. In the brassiere disclosed in Patent Document 1, the pad is shaped to extend from the middle of the edge along the verge's line of the breast to the upper end of the side edge of the cup part. In the brassiere disclosed in Patent Document 1, the pad is fixed to reduce the trouble of attaching the pad and the like. On the other hand, it is not considered in the brassiere described in Patent Document 1 to cope with changes in the size and position of the bust.

Patent Document 2 discloses a brassiere having a pocket for inserting a pad for correcting the difference in size between the right and left breasts. The pocket is formed between a cup body and an inner surface material. The inner surface material has an opening communicating with the pocket. The edges of the opening overlap together to form the lid of the opening in the pocket. Further, Patent Document 2 discloses that a more comfortable fit is provided by using a knit material having a moisture retaining function as the inner surface material.

On the other hand, Patent Document 3 discloses a foundation in which the periphery of a cup is made of a stretchable fabric so that it can be fitted to the body and function as a foundation even if there is a difference between the right and left breasts. In the foundation of Patent Document 3, the back surface of a contact part with semicircular portions on which bust cups are to be disposed and a stretchable fabric having the bust cups sewn in the same shape as the back surface are overlapped together, the side edges and the lower edge of the stretchable fabric are sewn to the contact part, and the front centers of the bust cups are sewn together with the stretchable fabric to the contact part.

Furthermore, there are publicly known brassieres capable of insertion and removal of wires depending on a feeling of pressure and physical condition. For example, Patent Document 4 discloses that wires are inserted into tubular fabrics for wire attachment on the back sides of the cup parts of a brassiere, at least one end of each of the tubular fabrics for wire attachment is set as a wire removal port, and the wire is inserted into and removed from the wire removal port. In the brassiere of Patent Document 4, the wires can be inserted and removed, and the inside of each of the tubular fabrics are provided with a wire retaining member at the removal port and is further reinforced by a fixed reinforcing member, thereby to prevent the wires from dropping out.

PRIOR ART DOCUMENTS

Patent Documents

Patent Document 1: Utility Model Registration No. 3213340
Patent Document 2: Utility Model Registration No. 3178563
Patent Document 3: JP-UM-B-56-12241
Patent Document 4: JP-A-11-12808

SUMMARY OF THE INVENTION

Problems to be Solved by the Invention

As described above, there are publicly known brassieres having the function of adjusting the difference between the right and left breasts. In one of cases where such a brassiere is used, breast reconstruction is performed after removing the breast in treatment of breast cancer and the like. Methods of breast reconstruction include implant and transplantation of autologous tissue. In any case, it is desired to protect the treated breast and adjust the difference between the treated breast and the healthy breast to obtain an even appearance of the two breasts during treatment, and until the operative site is stabilized, and thereafter.

After a surgery of breast reconstruction, it is recommended to wear a non-wire brassiere for a while. Even after the use of a wire brassiere becomes possible, brassieres with less feeling of pressure and a gentle touch on the skin are often desired. On the other hand, the treated breast may change over time depending on the postoperative course and physical condition, and the healthy breast may also change due to weight gain or loss. Therefore, the difference between the right and left breasts may occur with the passage of time, and the difference may change. Furthermore, since the difference between the right and left breasts appears not only in the volume and shape but also in the underbust position. Thus, it is also desirable to adjust the underbust positions (vertical difference) to adjust the difference between the right and left breasts.

In view of the above circumstances, an object of the present invention is to provide a brassiere that is capable of adjusting wires, adjusting the volumes and underbust positions of right and left breasts, and coping with temporal changes between the right and left breasts according to postoperative course of breast reconstruction, has a small feeling of pressure, is gentle on the skin, prevents long-term complications, and maintains the symmetrical breasts for a long time.

Means for Solving the Problems

The inventors have repeated studies to solve the above problems, and discovered that including pad insertion pockets inside cups, allowing insertion and removal of brassiere wires, and providing wire insertion parts on the front surface of the brassiere to reduce unevenness on the skin-touch side make it possible to adjust the volumes and underbust positions of the breasts, facilitate the wire replacement, and enhance skin feeling. Furthermore, the inventors have discovered that making a base part of the brassiere in a double structure of a front-side base part including the wire insertion parts and a skin-side base part in which a cup surrounding part is made of a stretchable material makes the brassiere fit to the breasts regardless of the presence or absence and size of wires and support the breasts while the underbust positions are adjusted by underbust adjustment pads as necessary, thereby to obtain the brassiere that can eliminate the difference between the right and left breasts and cope with changes in the condition of the breasts, and is comfortable to wear. In this manner, the inventors have completed the present invention.

That is, the present invention is configured as follows:

[1] A brassiere including a pair of right and left cup parts, a base part supporting the cup parts, a back part, and straps, wherein each of the cup parts has, on a back surface, an underbust adjustment pocket extending from a front center top to a side top along a cup lower edge of the cup part and a volume adjustment pocket that occupies at least a portion of the cup, the base part is continuous with the cup part and has a stretchable skin-side base part and a front-side base part that are layered, the front-side base part including a wire insertion part that has substantially the same curve as a curve of the lower edge of the cup part on a front surface, the skin-side base part and the front-side base part are fixed to each other at the front center tops, side edges, and a lower end, and the cup lower edge of the skin-side base part and the wire insertion part of the front-side base part are not fixed to each other except for both ends thereof.

[2] The brassiere according to [1], wherein, in each of the cup parts, the underbust adjustment pocket is provided closer to the skin than the volume adjustment pocket, and an opening in the underbust adjustment pocket is provided to open toward the front side of the brassiere.

[3] The brassiere according to [1] or [2], wherein, in each of the cup parts, a banana-shaped pad having a curve along a line from the front center top of the cup part to the side portion along the cup lower edge is removably inserted in the underbust adjustment pocket.

[4] The brassiere according to anyone of [1] to [3], wherein the skin-side base part is formed by overlapping stretchable lace and power mesh.

[5] The brassiere according to any one of [1] to [4], wherein the front-side base part has a wire insertion/removal port at least at one end of the wire insertion part, and the wire insertion/removal port includes a cover member on the front surface side to prevent a wire from coming off.

[6] The brassiere according to [5], wherein the wire is insertable and removable through the wire insertion/removal port, and the presence or absence of the wire insertion and the shape of the wire to be inserted are selectable.

[7] The brassiere according to anyone of [1] to [6], wherein stretchable lace is attached to at least an upper edge of each of the cup parts, a stretchable tape or flat elastic is attached to an edge of the stretchable lace, and the stretchable tape or flat elastic and the strap are provided continuously.

[8] The brassiere according to [1], wherein, in the base part, a length from the lowermost portion of the wire insertion part and the cup part to the lower end of the base part is 2 to 3 cm.

Effect of the Invention

According to the brassiere of the present invention, the presence or absence and shape of the wires, and the presence or absence and shape of the underbust adjustment pads and the volume adjustment pads can be selected. This makes it possible to obtain the brassiere that protects the operative site, ensures an excellent fit, and has an even appearance of the right and left breasts depending on the circumstances of the moment even if the right and left breasts change in condition and balance. In particular, the brassiere is configured such that the base part is of the double structure, specifically, the skin-side base part is stretchable and the front-side base part has the wire insertion part, which makes it possible to support the breasts while reducing the pressure on the breasts (in particular, the lower parts of the breasts). According to these configurations, it is possible to provide a brassiere that does not inhibit the wound healing process after breast reconstruction, can cope with long-term breast shape changes, has a gentle skin contact, prevents long-term complications, and can maintain the symmetrical breasts for a long period of time.

MODE FOR CARRYING OUT THE INVENTION

Hereinafter, a mode for carrying out the present invention will be described in more detail with reference to the drawings, but the illustrated embodiment is merely an example. The invention is not limited to the embodiment described here.

Figure 1:
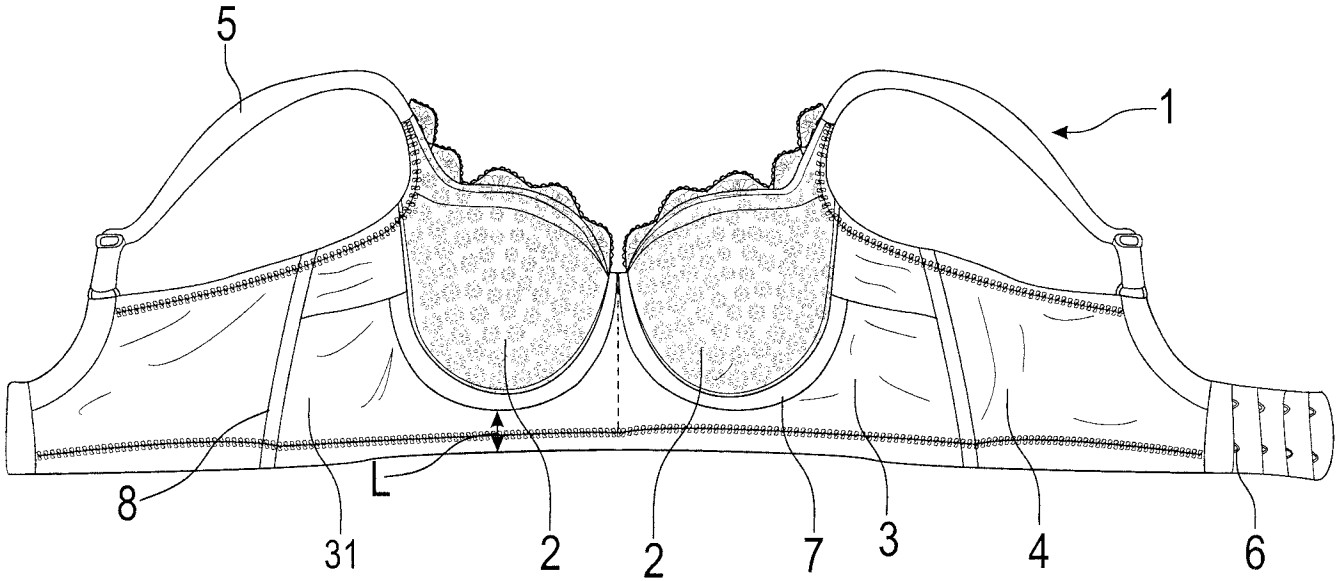
FIG. 1 is a view illustrating a brassiere (front surface) in an embodiment of the present invention.

FIG. 1 illustrates the whole front surface (garment side) of a brassiere 1 which is an example of the present invention. The brassiere 1 includes right and left cup parts 2, a base part 3 supporting the cup parts 2, a back part 4 connected to the base part 3, and straps 5 connecting the cup parts 2 and the back part 4. Hooks 6 are provided at the end of the back part 4. The right and left back parts 4 are engageable with each other by the hooks 6.

The base part 3 is formed by overlapping a front-side base part and a skin-side base part which have substantially the same shape. FIG. 1 illustrates only the front-side base part 31. The front-side base part 31 has wire insertion parts 7 on the front surface thereof. The curves of the wire insertion parts 7 are substantially the same as the curves of the lower edges of the cup parts 2. The front-side base part 31 has portions hollowed corresponding to the cup parts 2. Joint parts 8 are sewed between the base part 3 and the back part 4. A length L from the lowermost portion of the wire insertion part 7 to the lower end of the base part 3 is about 2.3 cm in the example of FIG. 1. The length L is preferably about 2 to 3 cm. By setting the length L from the lowermost portion of the wire insertion part 7 to the lower end of the base part 3 to about 2 to 3 cm, it is possible to obtain a brassiere that enables stretch of the skin-side base part, causes less displacement and wrinkles of the front-side base part and the skin-side base part, and is excellent in breast-supporting properties and wearing comfort.

In the embodiment illustrated in FIG. 1, the lower end of the base part 3 is linear, but may have a shape other than a linear shape. For example, the lower end of the base part 3 is preferably formed in a narrowed shape with the front center at the top such that the front center of the lower end of the base part is located above both the sides. Further, in the embodiment illustrated in FIG. 1, the wire insertion parts 7 are provided over the entire hollow curved parts corresponding to the cup parts 2. On the other hand, in another embodiment, it is also preferred that the wire insertion parts are preferably provided only at some portions of the hollow curved parts corresponding to the cup parts. Specifically, it is also preferred that the wire insertion parts are not extended to the front center top but are terminated about 1 to 2 cm below the front center top.

The back part 4 can be formed from a publicly known material selected as appropriate, for example, a stretchable material such as a power mesh or a cotton jersey knitting fabric. The upper end or the lower end of the back part 4 may be reinforced with a material that is highly stretchable in the length direction including, for example, a stretch tape such as a bias tape. In the case of using a stretch tape, the stretch tape may be disposed on either the front side or the skin side of the back part 4. Attaching the stretch tape to the front side would increase wearing comfort because the unevenness on the skin side is reduced.

In the example of FIG. 1, the hooks 6 have four segments, but the number of segments of the hooks may be smaller (two or three) or larger (six or eight). A large number of segments of the hooks is preferable, because the brassiere is easy to adjust in the degree of compression according to changes in physical condition or body shape, and the one-size brassiere can be favorably adapted to users of various body shapes.

Figure 2:
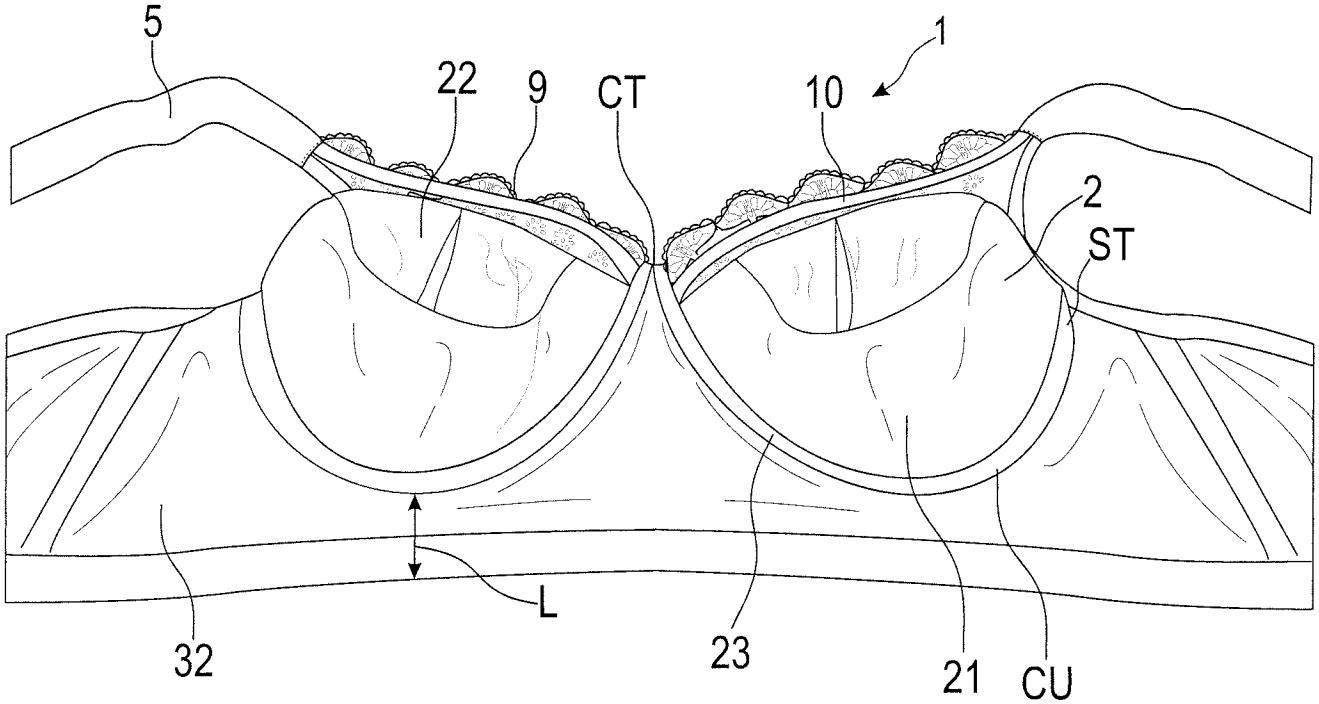
FIG. 2 is a view illustrating the brassiere (back surface) in the embodiment of the present invention.

FIG. 2 illustrates the back surface (skin side) of the brassiere 1. Each of the cup parts 2 includes an underbust adjustment pocket 21 and a volume adjustment pocket 22. The underbust adjustment pocket 21 extends from a front center top CT of the cup part 2 along a lower edge CU of the cup part 2 and reaches a side top ST. In the example of FIG. 2, the underbust adjustment pocket 21 has the vertical width enough to cover the lower half of the cup. The underbust adjustment pocket 21 may have a smaller vertical width. The opening of the underbust adjustment pocket 21 is provided at the inner side. In other words, the underbust adjustment pocket 21 is opened toward the front side of the brassiere so as to prevent unevenness on the skin side. By reducing unevenness on the skin side, it is possible to prevent the fabric of the brassiere from locally contacting the breasts and damaging the skin.

The skin-side base part 32 is provided continuously with the cup parts 2. Each of connecting parts 23 between the cup parts 2 and the skin-side base part 32 (that is, the lower edges CU of the cup parts 2) is edged with a non-stretchable tape, and no wire is inserted there. The skin-side base part 32 is made of a stretchable material, and in particular, a material stretchable in both the longitudinal and lateral directions is preferably used. Examples of the material include power mesh, stretchable lace, knit fabric, etc. In the example of FIG. 2, the skin-side base part 32 is formed of a power mesh and stretchable lace being layered. The lower end of the skin-side base part 32 is reinforced with a stretchable tape. In the example of FIG. 2, the length L from the lowermost portion of the lower edge CU of the cup part 2 to the lower end of the skin-side base part 32 is about 2.3 cm like the front surface side, and preferably about 2 to 3 cm.

The process of wound healing after breast reconstruction requires as long as half a year to over a year. In particular, in the case of autologous tissue transplantation, there is a process of angiogenesis in the transplanted tissue. If angiogenesis is inhibited in this process, subsequent events such as degeneration of engrafted tissue and scarring may occur. According to the brassiere of the present invention, the stretchable property of the skin-side base part 32 can reduce the pressure on the lower parts of the breasts where the pressure is particularly likely to occur. In addition, using a material stretchable in both the longitudinal and lateral directions for the skin-side base part 32 makes it possible to prevent the fabric of the brassiere from locally contacting the breasts and to evenly support the entire lower parts of the breasts, thereby reducing the inhibition of angiogenesis.

There is no particular limitation on the material of the cup parts 2. It is preferred that the cup bodies are made of a non-stretchable material. In addition, since the back surfaces of the cup parts 2 are brought into direct contact with the skin, it is preferred to use a material with favorable skin feeling, for example, a cotton jersey knitting fabric, a polyester material, a polyurethane material, a cotton-polyester blend material, a cotton-polyurethane blend material, and the like. In addition, stretchable lace is attached to the front surfaces of the cup parts 2, and flat elastic 10 are attached to the upper ends of the back surfaces of the attached stretchable lace 9. Providing the stretchable lace 9 and the flat elastic 10 at the upper ends of the cup parts 2 allows the brassiere to fit to the upper parts of the breasts without excessive compression, thereby improving supporting properties and wearing comfort. Stretchable tapes can be used instead of the flat elastic. In the example of FIG. 2, the width of the flat elastic 10 is 5 mm, but depending on the design and purpose, flat elastic with a width of about 4 to 8 mm can be used.

Further, the straps 5 are connected to the stretchable lace 9 and the flat elastic 10. That is, the straps 5 and the cup parts 2 are connected via the stretchable lace 9 and the flat elastic 10 as stretchable members. This configuration is preferable because the fit can be easily obtained regardless of the condition or volume of the breasts. In the example of FIG. 2, the stretchable lace 9 is used, but instead of the stretchable lace, stretchable knitting materials or the like may be used. In another embodiment, the straps and the cup parts can be connected via a non-stretchable member, or the straps and the cup parts can be directly connected.

In the embodiment illustrated in FIGS. 1 and 2, the stretchable lace disposed on the front surface of the skin-side base part 32 and the stretchable lace attached to the surfaces of the cup parts 2 are members separated from each other. In another embodiment, the brassiere of the present invention also preferably has a single stretchable member (for example, stretchable lace) attached to cover the front surface of the skin-side base part and the surfaces of the cup parts. In the case of covering from the skin-side base part to the cup parts with a single stretchable member, for example, the stretchable member advantageously can stretch and support even large-volume breasts with a more excellent fit.

Figure 3:
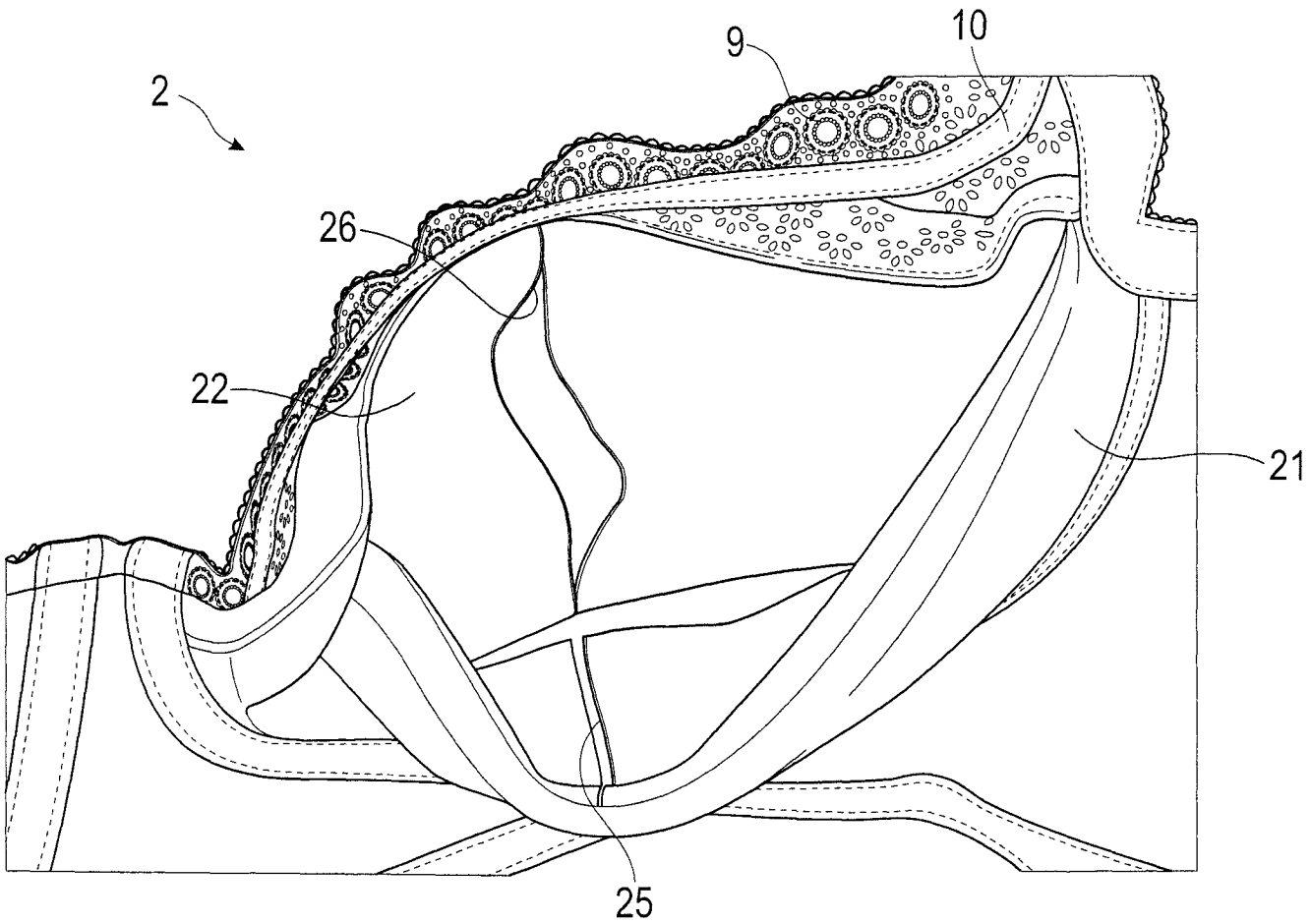
FIG. 3 is a view illustrating a pocket provided in a cup part of the brassiere in the embodiment of the present invention.

FIG. 3 particularly illustrates the pocket portion of one of the cup parts 2, which is a top plane view of the back surface of the cup in which the two pockets provided in the cup part 2 are opened. Each of the cup parts 2 has the underbust adjustment pocket 21 on the skin side, and the underbust adjustment pocket 21 internally has an opening 25 for taking in and out the pad. Further, each of the cup parts 2 has the volume adjustment pocket 22 on the back side of the cup part 2 and on the front side of the underbust adjustment pocket 21. The volume adjustment pockets 22 are pockets sized to occupy almost the entire cup parts 2, and optional pads can be inserted into the volume adjustment pockets 22 to adjust the difference in volume between the right and left breasts. Besides the illustrated example, each of the volume adjustment pockets 22 may be a pocket that occupies any portion, such as the side portion of the cup, the upper half of the cup, or another portion. In addition, a plurality of volume adjustment pockets may be provided for each of the cup parts. Each of the volume adjustment pockets 22 has an opening 26 therein for taking in and out the pad. In other words, each of the volume adjustment pockets 22 is provided to open toward the skin side of the brassiere.

Figure 4:
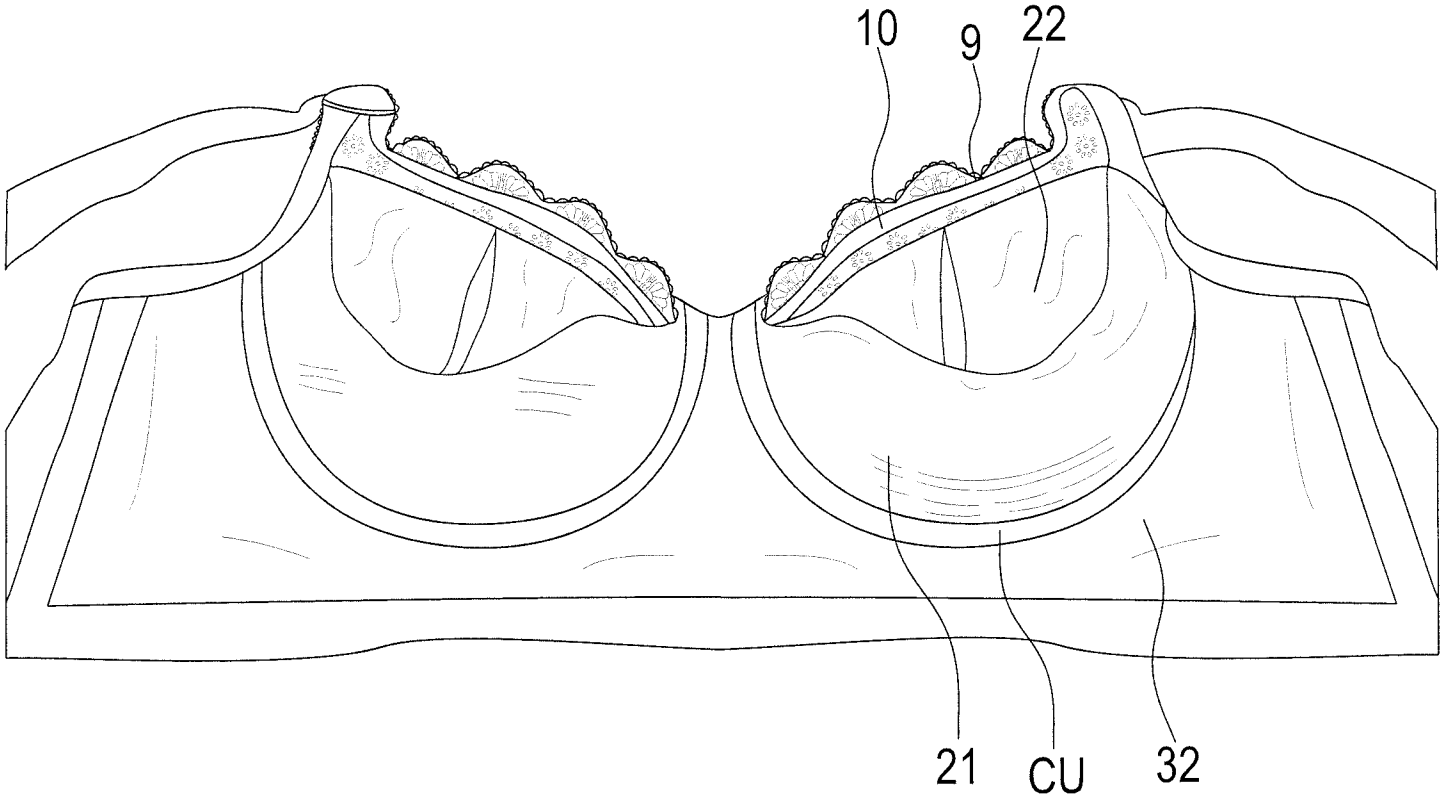
FIG. 4 is a view illustrating a state in which an underbust adjustment pad is inserted in one of the cups of the brassiere in the embodiment of the present invention.

FIG. 4 illustrates the underbust adjustment pad inserted into the underbust adjustment pocket 21 in one of the cups (right). No pad is inserted in the other cup (left). When the underbust adjustment pad is inserted, the entire lower edge of the cup is supplemented by the pad. When the underbust positions of the user's right and left breasts are different, the apparent underbust positions can be adjusted by putting an underbust adjustment pad in the cup on the side where the underbust position is relatively high. When the underbust positions of the right and left breasts are different, there occur problems that the brassiere inclines toward one side, the clothes line becomes distorted, or the brassiere is not comfortable to wear. These problems can be adjusted by adjusting the underbust positions. In addition, when the underbust positions of the right and left breasts are different, the brassiere will be supported only by the shoulder on the side on which the underbust position is lower, which places a large burden on the body to cause stiff shoulder. The burden on the body can be reduced by adjusting the underbust positions.

Further, providing the underbust adjustment pockets 21 on the skin side suppresses the underbust adjustment pads from being shifted upward, and thus the underbust adjustment pads effectively function as base parts of the breasts. In particular, an implanted breast is lower in softness and capability of following the posture than a breast of a living body and thus tends to cause a displacement of a pad when the brassiere is worn. However, according to the above configuration, it is possible to hold the underbust adjustment pads at appropriate positions even when the brassiere is worn for a long time.

Further, in the brassiere of the present invention, the underbust adjustment pockets 21 and the volume adjustment pockets 22 are separately provided, and thus it is possible to flexibly cope with the case where only the underbust positions are to be adjusted, or the case where only the volumes are to be adjusted. Furthermore, the brassiere of the present invention includes the underbust adjustment pockets and the stretchable skin-side base part. Accordingly, when the underbust adjustment pads are used to adjust the right and left underbust positions, the skin-side base part stretches as appropriate with an excellent fit, thereby aligning the underbust positions with a smaller burden on the body.

Figure 5:
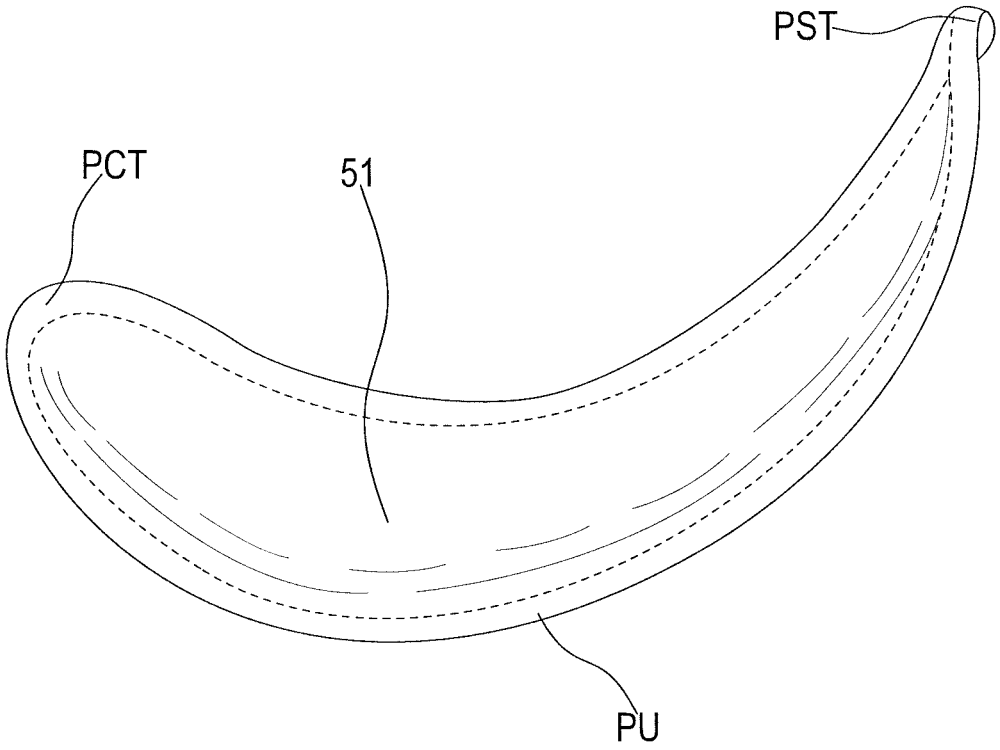
FIG. 5 is a view illustrating the underbust adjustment pad used in the brassiere in the embodiment of the present invention.

FIG. 5 illustrates the underbust adjustment pad 51. The curve of a lower edge PU of the underbust adjustment pad 51 is shaped broadly along the lower edge CU (see FIG. 4) of the cup part 2. A front center top PCT broadly corresponds to the front center top CT of the cup part 2, and a side top portion PST broadly corresponds to the side top portion ST of the cup part 2. Each of the underbust adjustment pads 51 is a banana-shaped pad such that the maximum width in the vicinity of the lowermost part of the verge's line is about 3.5 cm and the width becomes gradually smaller in the side directions. The thickness of each of the underbust adjustment pads 51 is about 1 cm. With such a shape, the underbust adjustment pads 51 form natural verge's lines and are effective in adjustment of the right and left underbust positions. Each of the underbust adjustment pads 51 may have any shape other than that of the example illustrated in FIG. 5 such as a shape different in width or thickness or a rounded shape. For example, each of the underbust adjustment pads 51 can have a largest width of about 1 cm to 4 cm and a thickness of about 0.5 cm to 3 cm.

The materials of the underbust adjustment pad and the volume adjustment pad can be selected from known materials according to the purpose and design. For example, resilient and formable materials such as natural fiber and/or synthetic fiber cotton, urethane foam resin, and silicone can be used by being wrapped in a fabric such as tricot.

Figure 6:
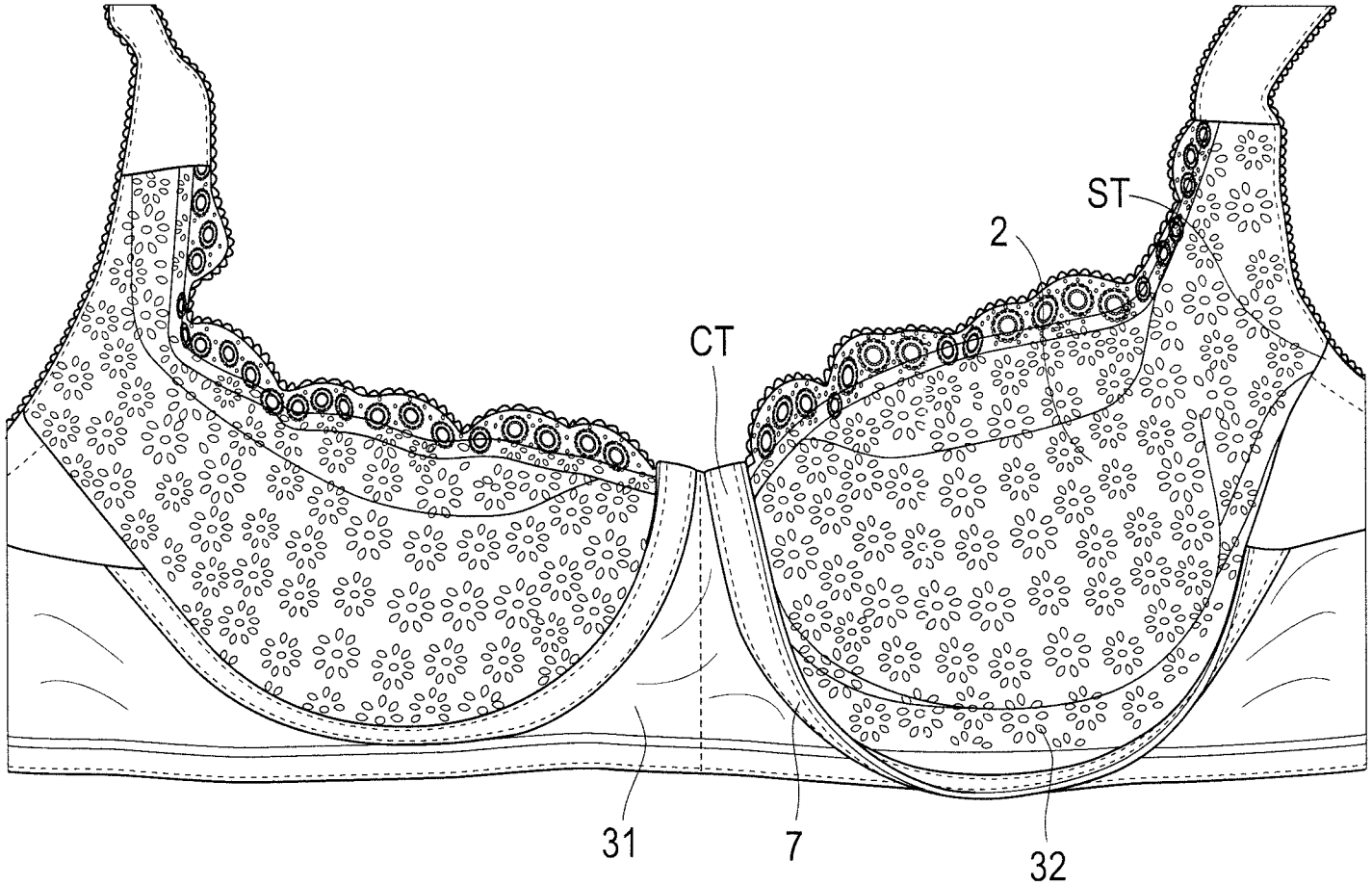
FIG. 6 is a view illustrating a front-side base part and a skin-side base part of the brassiere in the embodiment of the present invention.

FIG. 6 is a view illustrating the skin-side base part 32 in such a manner as to be partially visible on the front side of the brassiere 1. The skin-side base part 32 is made of a stretchable material in which a power mesh and stretchable lace are overlapped. FIG. 6 illustrates the stretchable lace provided on the front side of the skin-side base part 32. The front-side base part 31 and the skin-side base part 32 are fixed to each other at the cup front center tops CT, the lower end of the base part 3, and the side edges 8 of the base part. The lower edges of the cup parts 2 and the wire insertion parts 7 are not fixed to each other except for both the ends (front center tops CT and side tops ST) as illustrated in FIG. 6. Both the ends can be fixed by any method such as sewing or using an adhesive or a clip-like engaging member.

In the brassiere of the present invention, the structure of the base part 3 in which the front-side base part 31 and the skin-side base part 32 are overlapped and only partially fixed to each other allows the surroundings of the cups to extend and contract and fit to the breasts according to the sizes of the breasts. This makes it possible to obtain adequate supporting properties even in the case of using the brassiere without wires. In addition, in the case of using the brassiere with wires, the wires do not excessively compress the breasts. Furthermore, since the cups and the wires are not fixed to each other, the cups do not deform even if the shapes of the wires to be inserted are changed. Accordingly, the wires to be inserted can be selected or changed according to the physical condition, postoperative course, the change of the body shape, and other reasons. For example, even when different wires are used on the right and left, the right and left cups are fitted to the breasts by stretch of the skin-side base part, and the wires support the peripheries of the breasts.

The wires may be selected as appropriate from wires of basic shape having a curve substantially the same as a curve of the lower edge of the cup part 2, wires having different width (pitch) or curves of verge's lines, wires of softer materials, and others. Each of the wires may extend from the cup front center top CT to the side top ST of the cup, or may be shorter to correspond to only a portion of the verge's line, without particular limitation. The material of the wires may be a known material such as plastic or metal wires.

In particular, after breast reconstruction with an implant, a capsular may occur around the implant in the body and the local contact or compression by the brassiere-wires may cause capsular contracture. For this problem, in the brassiere of the present invention, the presence or absence of the wires and the shape of the wires can be selected. In addition, since the wires are provided on the front surface of the brassiere, direct compression is small and the skin-side base part stretches and appropriately support the lower parts of the breasts. Therefore, it is considered that compression of the breasts due to improper placement of the wires is avoided. In addition, depending on the form of mastectomy, tissue around the axilla may become thin even after breast reconstruction. In such a case, there is a risk that the skin may be damaged by the impact of the side wires. According to the brassiere of the present invention, however, it is possible to select the presence or absence and the shape of the wires, thereby reducing the cause of such a subsequent complication.

Figure 7A:
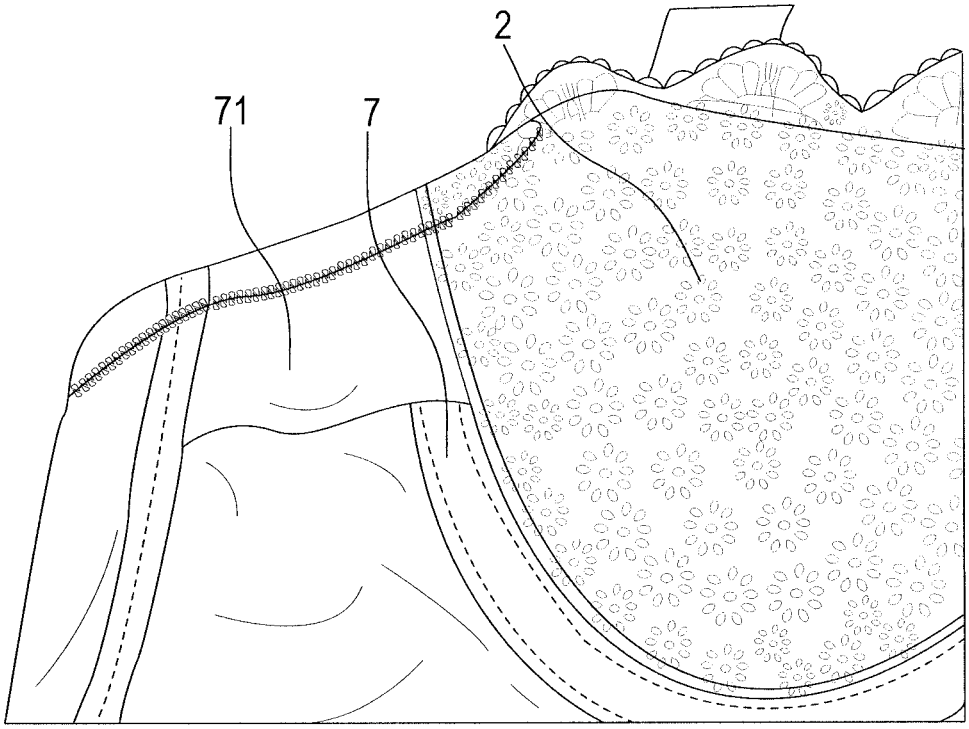
FIGS. 7A and 7B are each a view illustrating a wire insertion/removal port and its periphery of the brassiere in the embodiment of the present invention.
Figure 7B:
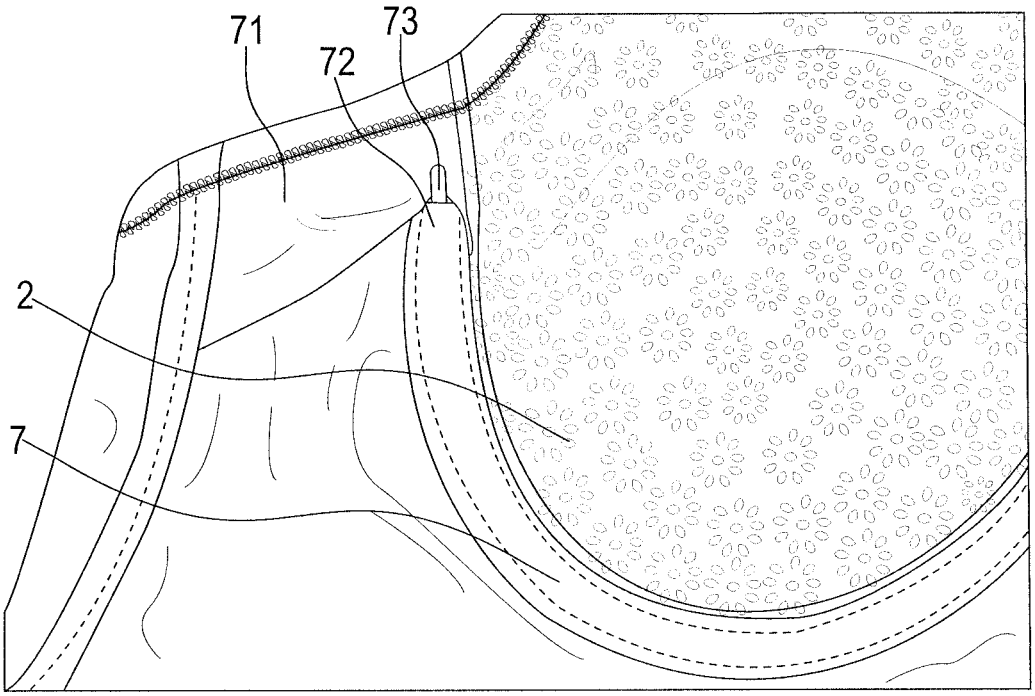

FIGS. 7A and 7B are each an enlarged view of the cup 2 and the wire insertion part 7. FIG. 7A illustrates a normal state, and FIG. 7B illustrates a state at the time of insertion or removal of a wire. That is, the wire insertion part 7 has a wire insertion/removal port at least at one end, and a cover member 71 is provided on the front surface side thereof. The end of the wire insertion part 7 is not sealed but constitutes a wire insertion/removal port 72. When inserting or removing the wire, the wire 73 can be taken in or out through the wire insertion/removal port 72 located under the cover member 71. Providing the cover member 71 on the front surface side makes it possible to prevent the wire from coming off and facilitate the insertion and removal of the wire, and reduce the unevenness on the back surface with favorable skin feeling. In the example of FIGS. 7A and 7B, the cover member 71 covers about 3 cm at the end of the wire insertion part 7, but the coverage can be appropriately changed according to the design.

In the brassiere of the present invention, allowing free insertion and removal of wires makes it possible to select the presence or absence of each of the right and left wires and the size of the wires according to postoperative course, the condition of the operative site, and other reasons. In addition, allowing free insertion and removal of wires, separating the wire insertion parts and the cup parts from each other, and providing the stretchable base part (skin-side base part) of the cup parts make it possible to, even in the case of inserting a wire only on either the right or left or using different wires on the right and left, adjust the difference by the stretching properties of the skin-side base part and obtain a natural appearance with an excellent fit.

The brassiere of the present invention is useful to those who have a difference between the right and left breasts, especially those who have experienced breast reconstruction, which can solve the problems of a difference between the right and left underbust positions, a difference in breast size, and the presence or absence of brassiere wires after breast reconstruction at the same time. The structure of the brassiere of the present invention may be not only a brassiere but a slip with a brassiere, a brassiere camisole, and others.

DESCRIPTION OF REFERENCE SIGNS

1 Brassiere
2 Cup part
3 Base part
31 Front-side base part
32 Skin-side base part
4 Back part
5 Strap
6 Hook
7 Wire insertion part
8 Side edge of base part
9 Stretchable lace
10 Flat rubber
21 Underbust adjustment pocket
22 Volume adjustment pocket
23 Connecting part between cup part and skin-side base part
25 Opening in underbust adjustment pocket
26 Opening in volume adjustment pocket
51 Underbust adjustment pad
71 Cover member
72 Wire insertion/removal port
73 Wire

The invention claimed is:

1. A brassiere including right and left cup parts each having an interior, a base part supporting the cup parts, a back part, and straps, wherein each of the cup parts has, on a back surface, (a) an underbust adjustment pocket extending from a front center top of the cup part along a cup lower edge to a side portion of the cup part and (b) a volume adjustment pocket that occupies substantially an entire interior of the cup part, the base part is continuous with the cup parts and has a stretchable skin-side base part configured to lie on a skin surface of a wearer and a front-side base part having a front surface side configured to lie opposite said skin surface, both said skin-side base part and said front-side base part being layered, the front-side base part including a curved wire insertion part that has substantially the same curvature as a curve of the lower edge of the cup part on a front surface thereof, the skin-side base part and the front-side base part arc fixed to each other at the front center tops, side edges, and a lower end, and the cup lower edge of the skin-side base part and the wire insertion part of the front-side base part are not fixed to each other except for both ends thereof.

2. The brassiere according to claim 1, wherein, in each of the cup parts, the underbust adjustment pocket is provided closer to the skin surface of the wearer than the volume adjustment pocket, and an opening in the underbust adjustment pocket is provided to open toward a side of the cup part configured to lie opposite the skin surface of the wearer.

3. The brassiere according to claim 1, wherein, in each of the cup parts, a banana-shaped pad having a curve along a line from the front center top of the cup part to the side portion of the cup part along the cup lower edge is removably inserted in the underbust adjustment pocket.

4. The brassiere according to claim 1, wherein the skin-side base part is formed by overlapping stretchable lace and power mesh.

5. The brassiere according to claim 1, wherein the front-side base part has a wire insertion/removal port at least at one end of the wire insertion part, and the wire insertion/removal port includes a cover member on the front surface side to prevent a wire from coming off.

6. The brassiere according to claim 5, additionally including a wire insertable and removable through the wire insertion/removal port, the presence or absence of the wire insertion and the shape of the wire to be inserted being selectable.

7. The brassiere according to claim 1, wherein (a) stretchable lace is attached to at least an upper edge of each of the cup parts, (b) a stretchable tape or flat elastic is attached to an edge of the stretchable lace, and (c) the stretchable tape or flat elastic and the strap are provided continuously.

8. The brassiere according to claim 1, wherein the wire insertion part has a lowermost portion disposed about 2 to 3 cm from the lower end of the base part.

* * * * *